US009635479B2

(12) United States Patent
Hillbratt et al.

(10) Patent No.: US 9,635,479 B2
(45) Date of Patent: Apr. 25, 2017

(54) HEARING PROSTHESIS FITTING INCORPORATING FEEDBACK DETERMINATION

(71) Applicant: Cochlear Limited, Sydney (AU)

(72) Inventors: Martin E. G. Hillbratt, Vastra Gotaland (SE); Björn Davidsson, Gothenburg (SE)

(73) Assignee: Cochlear Limited, Macquarie University (AU)

( * ) Notice: Subject to any disclaimer, the term of this patent is extended or adjusted under 35 U.S.C. 154(b) by 0 days.

(21) Appl. No.: 13/861,493

(22) Filed: Apr. 12, 2013

(65) Prior Publication Data

US 2014/0275732 A1 Sep. 18, 2014

Related U.S. Application Data

(60) Provisional application No. 61/799,757, filed on Mar. 15, 2013.

(51) Int. Cl.
*H04R 25/00* (2006.01)

(52) U.S. Cl.
CPC ..... *H04R 25/70* (2013.01); *H04R 25/453* (2013.01); *H04R 2430/03* (2013.01)

(58) Field of Classification Search
CPC ..... A61N 1/36017; A61N 1/36025; A61N 1/36032; A61N 1/36064; A61N 1/36067; A61N 1/36075; A61N 1/36135; A61N 1/36146; A61N 1/37252; H04R 25/70; H04R 25/453; H04R 2430/03
USPC ..... 381/326, 60, 312, 314, 316, 317, 318; 607/45, 57
See application file for complete search history.

(56) References Cited

U.S. PATENT DOCUMENTS

| | | | | |
|---|---|---|---|---|
| 6,792,114 | B1 | 9/2004 | Kates | |
| 2008/0260171 | A1 | 10/2008 | Nordahn | |
| 2008/0298615 | A1* | 12/2008 | Klinkby | H04R 25/453 381/318 |
| 2009/0147977 | A1 | 6/2009 | Lamm | |

(Continued)

FOREIGN PATENT DOCUMENTS

| | | |
|---|---|---|
| EP | 2136575 | 12/2009 |
| EP | 01830603 | 11/2010 |

(Continued)

OTHER PUBLICATIONS

E. Gaudrain & R. P. Carlyon, Using Zebra-speech to study sequential and simultaneous speech segregation in a cochlear-implant simulation, J. Acoust. Soc. Am., vol. 133, No. 1, pp. 502-518, Cambridge, UK (Jan. 2013).

*Primary Examiner* — Davetta W Goins
*Assistant Examiner* — Phylesha Dabney
(74) *Attorney, Agent, or Firm* — McDonnell Boehnen Hulbert & Berghoff LLP

(57) ABSTRACT

The present application discloses systems and methods to analyze feedback path information during a fitting session. In accordance with one embodiment, a method is provided and includes during a fitting session, calculating a feedback gain margin of a hearing prosthesis by causing the hearing prosthesis to receive a test signal, output an output signal based on the test signal, and receive a feedback signal based on the output of the output signal, the test signal being configured to test a different parameter of the hearing prosthesis.

19 Claims, 5 Drawing Sheets

(56) References Cited

U.S. PATENT DOCUMENTS

| | | | | |
|---|---|---|---|---|
| 2009/0177247 | A1* | 7/2009 | Neal et al. | 607/57 |
| 2010/0177917 | A1* | 7/2010 | Van Der Werf | H04R 25/453 381/318 |
| 2011/0026725 | A1 | 2/2011 | Kunzle | |
| 2013/0188796 | A1* | 7/2013 | Kristensen | H04R 25/453 381/60 |

FOREIGN PATENT DOCUMENTS

| | | |
|---|---|---|
| EP | 2189006 | 6/2011 |
| WO | WO 2008 000843 | 1/2008 |

* cited by examiner

HEARING PROSTHESIS FITTING INCORPORATING FEEDBACK DETERMINATION

BACKGROUND

Various types of hearing prostheses may provide persons with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural signals, or any other part of the ear, auditory nerve, or brain that may process the neural signals.

Persons with some forms of conductive hearing loss, some forms of sensorineural hearing loss, or some forms of both conductive hearing loss and sensorineural hearing loss may benefit from the use of hearing prostheses. For example, acoustic hearing aids or vibration-based hearing devices may provide persons having conductive hearing loss with the ability to perceive sound by causing vibrations in the person's inner ear (e.g., by directly stimulating the inner ear or by applying vibrations to bone), thus bypassing the person's auditory canal and middle ear. Cochlear implants may provide a person having sensorineural hearing loss with the ability to perceive sound by stimulating the person's auditory nerve via an array of electrodes implanted in the person's cochlea. In addition, some hearing prosthesis systems utilize a hybrid approach combining an acoustic or vibration-based device with a cochlear implant.

The effectiveness of any of these hearing prostheses depends not only on the design of the particular prosthesis but also on how well the device is configured for or "fitted" to a recipient. The process of "fitting" a hearing prosthesis with an appropriate set of configuration parameters (e.g., the operating instructions defining the particular manner in which the prosthesis detects acoustic signals and delivers responsive stimulation to the relevant portions of a person's outer ear, cranial or facial bones, teeth, middle ear, inner ear, cochlea, or brainstem) is often performed by an audiologist or other similarly-trained specialist typically in an office setting or other professional setting away from the prosthesis recipient's home.

The fitting process can include steps to configure the prosthesis to help mitigate feedback. Generally, feedback results when the hearing prosthesis produces an output that returns as an input to the hearing prosthesis. In some cases, this results in a feedback loop, which can produce undesirable sound sensations to the prosthesis recipient. Therefore, it is generally advantageous to provide a fitting process, in which an audiologist or other professional can analyze the way in which each hearing prosthesis encounters feedback and provide an appropriate set of configuration parameters to help mitigate potential feedback. Moreover, it is generally advantageous to make this fitting process as efficient as possible.

SUMMARY

The present application discloses systems and methods designed to collect and analyze feedback path information in an efficient way. In accordance with at least some embodiments of the present disclosure, a method is provided and includes a hearing prosthesis receiving a test signal from a fitting system, where the test signal is configured for testing a parameter in addition to feedback, the hearing prosthesis generating an output signal is based on the received test signal, the output signal spans a plurality of frequency bands, with each individual frequency band having associated therewith a component output signal, the hearing prosthesis identifies from among the plurality of frequency bands a subset of frequency bands, in which each frequency band of the subset has an associated component output signal with a power level greater than a threshold power level, and in response to the identifying, the hearing prosthesis aggregating feedback-path information for each frequency band in the identified subset of frequency bands.

In accordance with another embodiment, a hearing prosthesis is disclosed and includes a sound input element, a transducer module communicatively coupled to the sound input element, and coupled to at least one of the sound input element and the transducer module, one or more processors, the one or more processors being configured for (i) receiving via the sound input element a signal from an external system; (ii) in response to the receiving, the transducer module providing a stimulation signal; (iii) identifying parts of the stimulation signal that have a power level above a threshold power level; and (iv) aggregating feedback path information for each identified part of the stimulation signal.

In accordance with another embodiment, a system is provided and includes memory storage, at least one processor, and program code stored in the memory storage, wherein the program code is executable by the processor to carry out functions comprising: during a fitting session, calculating a feedback gain margin of a hearing prosthesis by causing the hearing prosthesis to receive a test signal, output an output signal based on the test signal, and receive a feedback signal based on the output of the output signal, the test signal being configured to test a different parameter of the hearing prosthesis.

DETAILED DESCRIPTION

The following detailed description describes various features and functions of the disclosed systems and methods with reference to the accompanying figures. In the figures, similar symbols typically identify similar components, unless context dictates otherwise. The illustrative system and method embodiments described herein are not meant to be limiting. Certain aspects of the disclosed systems and methods can be arranged and combined in a wide variety of different configurations, all of which are contemplated herein.

Certain aspects of the disclosed systems, methods, and articles of manufacture may be described herein with reference to hearing prosthesis embodiments and, more particularly, to vibration-based hearing prostheses or direct acoustic stimulation prostheses. However, the disclosed systems, methods, and articles of manufacture are not so limited. Some of the disclosed features and functions described with respect to vibration-based hearing prostheses or direct acoustic stimulation prostheses may be equally applicable to other embodiments that include other types of stimulation prostheses including stimulators in which an actuator is coupled directly to the middle ear via a mechanical coupling, general acoustic hearing aids, cochlear implants, prosthetic-limb stimulation devices, auditory brain stem implants, or any other type of medical stimulation prosthesis that experiences feedback.

Figure 1:
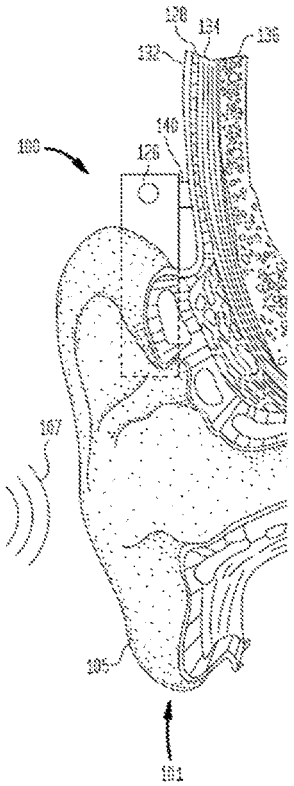
FIG. 1 depicts an example hearing prosthesis arrangement.

FIG. 1 is a perspective view of an example vibration-based hearing prosthesis in accordance with one embodiment of the present disclosure. In particular, FIG. 1 depicts a percutaneous bone conduction device 100 positioned behind an outer ear 101 of a recipient to aid in the perception of sound. Bone conduction device 100 comprises a sound input element 126 to receive sound signals 107. The sound input element 126 can be a microphone, telecoil, or similar device. In the example depicted, sound input element 126 is located on bone conduction device 100. However, in other embodiments, sound input element 126 is located in bone conduction device 100 or, alternatively, on a cable extending from bone conduction device 100. Bone conduction device 100 additionally includes a sound processor (not shown), a vibrating electromagnetic actuator, and/or various other operational components.

In accordance with example operation of bone conduction device 100, sound input device 126 converts received sound signals into electrical signals. These electrical signals are then processed by the sound processor. In turn, the sound processor generates control signals that cause the actuator to vibrate. In other words, the actuator converts the electrical signals into mechanical force to impart vibrations to skull bone 136 of the recipient.

In the example depicted, bone conduction device 100 further includes coupling apparatus 140 to attach bone conduction device 100 to the recipient. As depicted, coupling apparatus 140 is attached to an anchor system (not shown) implanted in the recipient. Some example anchor systems (which are sometimes referred to as fixation systems) include a percutaneous abutment fixed to the recipient's skull bone 136. The abutment extends from skull bone 136 through muscle 134, fat 128 and skin 132 so that coupling apparatus 140 may be attached thereto. Such a percutaneous abutment provides an attachment location for coupling apparatus 140 that facilitates efficient transmission of mechanical force.

Figure 2:
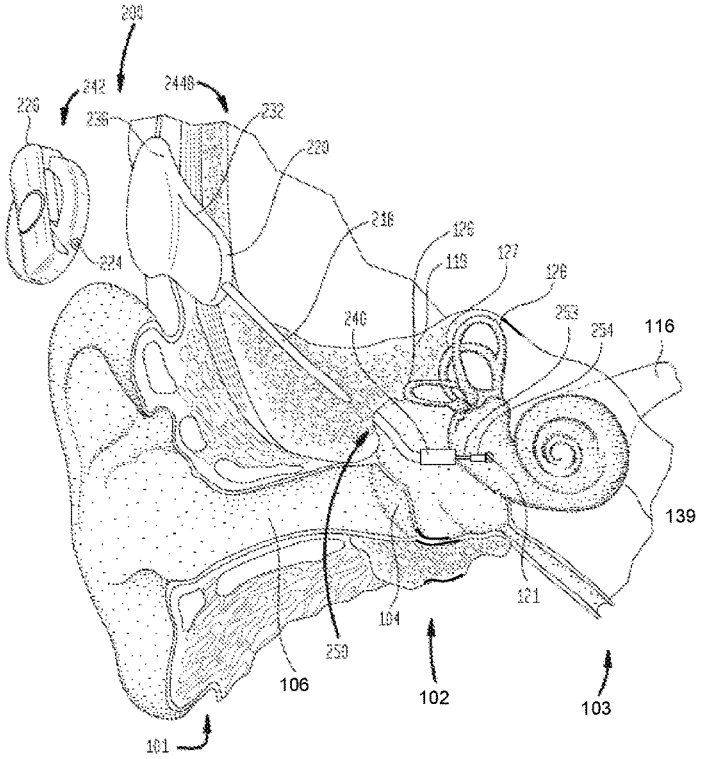
FIG. 2 depicts an example hearing prosthesis arrangement.

FIG. 2 is a perspective view of a different type of hearing prosthesis referred to as a direct acoustic stimulator 200, in accordance with one embodiment of the present disclosure. In particular, the direct acoustic stimulator 200 comprises an external component 242 that is directly or indirectly attached to the body of the recipient, and internal component 244B which is implanted in the recipient. External component 242 typically includes one or more sound input elements, such as a microphone 224, a sound processing unit 226, a power source (not shown), and an external transmitter unit (not shown). In addition, internal component 244B comprises internal receiver unit 232, stimulator unit 220, and stimulation arrangement 250. Stimulation arrangement 250 is typically implanted in middle ear 102.

In accordance with the example depicted, stimulation arrangement 250 comprises actuator 240, stapes prosthesis 254 and coupling element 253 connecting the actuator to the stapes prosthesis. In this example, stimulation arrangement 250 is implanted and/or configured such that a portion of stapes prosthesis 254 abuts round window 121. It should be appreciated that stimulation arrangement 250 may alternatively be implanted such that stapes prosthesis 254 abuts an opening in horizontal semicircular canal 146, in posterior semicircular canal 127 or in superior semicircular canal 148.

In operation, a sound signal is received by one or more microphones 224, processed by sound processing unit 226, and transmitted as encoded data signals to internal receiver 232. Based on these received signals, stimulator unit 220 generates drive signals that cause actuation of actuator 240. This actuation is transferred to stapes prosthesis 254 such that a wave of fluid motion is generated in the perilymph in scala tympani. Such fluid motion, in turn, activates the hair cells of the organ of Corti. Activation of the hair cells in the cochlea 139 causes appropriate nerve impulses to be generated and transferred through the spiral ganglion cells (not shown) and auditory nerve 116 to the brain (not shown) where they are perceived as sound.

FIG. 2 is just one example of a direct acoustic stimulator and, in other arrangements, other types of direct acoustic stimulation are implemented. Further, although FIG. 2 provides an illustrative example of a direct acoustic stimulator system, in other configurations, a middle ear mechanical stimulation device can be configured in a similar manner, with the exception that instead of the actuator 240 being coupled to the inner ear of the recipient, the actuator is coupled to the middle ear of the recipient. For example, in such an arrangement the actuator stimulates the middle ear by direct mechanical coupling via coupling element 253 to the ossicles (middle ear bones).

Figure 3:
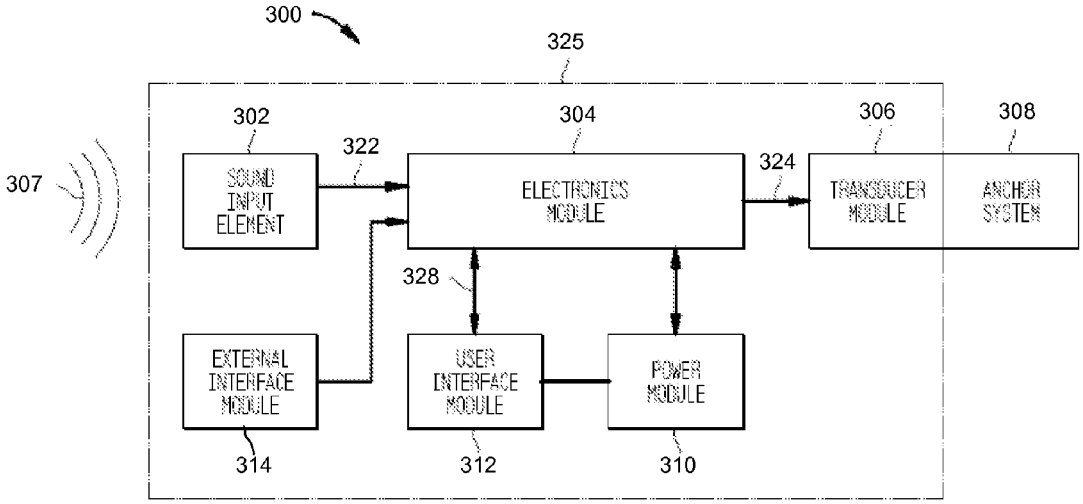
FIG. 3 depicts a block diagram of certain selected hearing prosthesis components.

FIG. 3 depicts a functional block diagram of one example of a hearing prosthesis 300, such as a vibration-based hearing prosthesis (e.g. a bone conduction device 100 (FIG. 1). However, as described above, the features and associated functionality described with reference to hearing prosthesis 300 may be equally applicable to other types of hearing or medical prostheses.

In operation, sound 307 is received by sound input element 302. In some arrangements, sound input element 302 is a microphone configured to receive sound 307, and to convert sound 307 into electrical signal 322. Alternatively, sound 307 is received by sound input element 302 as an electrical signal, such as via an input jack.

As further depicted in FIG. 3, electrical signal 322 is output by sound input element 302 to electronics module 304. Electronics module 304 is configured to convert electrical signal 322 into adjusted electrical signal 324. As described below in more detail, electronics module 304 may include a sound processor, control electronics, transducer drive components, and a variety of other elements, including, but not limited to one or more processors.

As further depicted in FIG. 3, when hearing prosthesis 300 is a bone conduction device, transducer module 306 receives adjusted electrical signal 324 and generates a mechanical output force that is delivered in the form of a vibration to the skull of the recipient via anchor system 308. Delivery of this output force causes motion or vibration of the recipient's skull, thereby activating the hair cells in the recipient's cochlea (not shown) via cochlea fluid motion. In other types of devices, anchor system 308 is omitted and transducer module 306 generates other types of stimulation (e.g., acoustic, mechanical, or hybrid stimulation, such as acoustic and electric, for example) for application to the recipient.

FIG. 3 also illustrates power module 310. Power module 310 provides electrical power to one or more components of hearing prosthesis 300. For ease of illustration, power module 310 has been shown connected only to user interface module 312 and electronics module 304. However, it should be appreciated that power module 310 may be used to supply power to any electrically powered circuits/components of hearing prosthesis 300.

User interface module 312, which is included in hearing prosthesis 300, allows the recipient to interact with hearing prosthesis 300. For example, user interface module 312 may allow the recipient to adjust the volume, alter the speech processing strategies, power on/off the device, etc. In the example of FIG. 3, user interface module 312 communicates with electronics module 304 via signal line 328.

Figure 4:
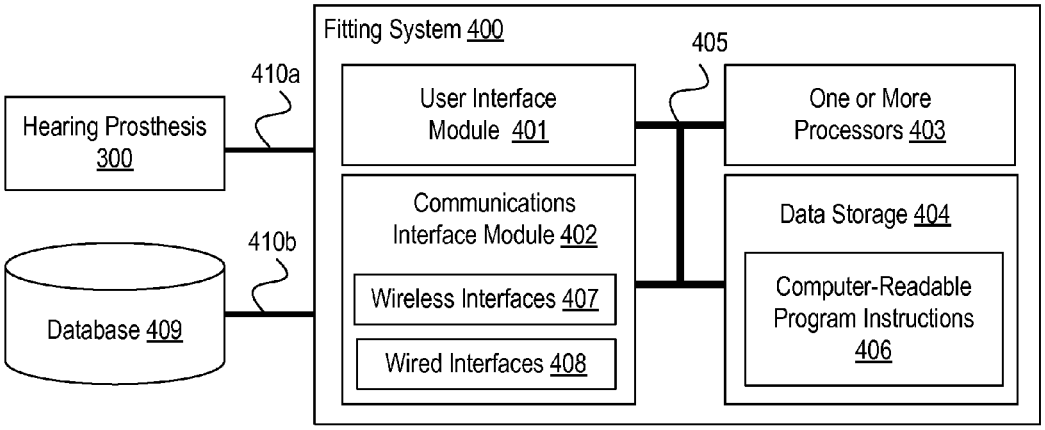
FIG. 4 depicts a block diagram of a fitting system.

Hearing prosthesis 300 may further include external interface module 314 to connect electronics module 304 to an external device, such as fitting system 400 depicted in FIG. 4. Using external interface module 314, the external device may obtain information from the hearing prosthesis 300 (e.g., the current parameters, data, alarms, etc.) and/or modify the parameters of the hearing prosthesis 300 used in processing received sounds and/or performing other functions.

In the example of FIG. 3, sound input element 302, electronics module 304, transducer module 306, power module 310, user interface module 312, and external interface module 314 have been shown as integrated in a single housing, referred to as housing 325. However, it should be appreciated that in certain examples, one or more of the illustrated components may be housed in separate or different housings. Similarly, it should also be appreciated that in such embodiments, direct connections between the various modules and devices are not necessary and that the components may communicate, for example, via wireless connections.

FIG. 4 shows a block diagram of an example of a fitting system 400 that is configurable to execute fitting software for a particular hearing prosthesis and to load configuration settings to the hearing prosthesis via the external interface module 314. As shown in FIG. 4, the fitting system 400 includes a user interface module 401, a communications interface module 402, one or more processors 403, and data storage 404, all of which may be linked together via a system bus or other connection circuitry 405. The fitting system 400 may include more, fewer, or different modules than those shown in FIG. 4.

In the fitting system 400 shown in FIG. 4, the user interface module 401 is configured to send data to and/or receive data from external user input/output devices such as a keyboard, keypad, touch screen, computer mouse, track ball, joystick, and/or other similar device, now known or later developed. The user interface module 401 is also shown configured to provide output to user display devices, such as one or more cathode ray tubes (CRT), liquid crystal displays (LCD), light emitting diodes (LEDs), displays using digital light processing (DLP) technology, printers, light bulbs, and/or other similar devices, now known or later developed. Furthermore, in some embodiments, the user interface module 401 is configured to generate audible output(s), such as through a speaker, speaker jack, audio output port, audio output device, earphone, and/or other similar device, now known or later developed.

As shown in FIG. 4, the communications interface module 402 includes one or more wireless interfaces 407 and/or wired interfaces 408 that are generally configurable to communicate with hearing prosthesis 300 via a communications connection 410*a*, to a database 409 via a communications connection 410*b*, or to other computing devices (not shown). Generally, connection 410*a* is any wired or wireless connection to external interface module 314 of hearing prosthesis 300.

The wireless interfaces 407 include one or more wireless transceivers, such as a Bluetooth transceiver, Wi-Fi transceiver, WiMAX transceiver, and/or other similar type of wireless transceiver configurable to communicate via a wireless protocol. The wired interfaces 408 include one or more wired transceivers, such as an Ethernet transceiver, Universal Serial Bus (USB) transceiver, or similar transceiver configurable to communicate via a twisted pair wire, coaxial cable, fiber-optic link, or other similar physical connection.

The one or more processors 403 include one or more general purpose processors (e.g., microprocessors manufactured by Intel or Advanced Micro Devices) and/or one or more special purpose processors (e.g., digital signal processors, application specific integrated circuits, etc.). As depicted in FIG. 4, the one or more processors 403 are configured to execute computer-readable program instructions 406 that are contained in the data storage 404 and/or other instructions based on algorithms described herein.

The data storage 404 may include one or more computer-readable storage media that can be read or accessed by at least one of the processors 403. The one or more computer-readable storage media may include volatile and/or non-volatile storage components, such as optical, magnetic, organic or other memory or disc storage, which can be integrated in whole or in part with at least one of the processors 403. In some embodiments, the data storage 404 may be implemented using a single physical device (e.g., an optical, magnetic, organic or other memory or disc storage unit), while in other embodiments, the data storage 304 may be implemented using two or more physical devices.

The data storage 404 includes computer-readable program instructions 406 and, in other embodiments, perhaps additional data. In some embodiments, for example, the data storage 404 additionally includes program instructions that perform or cause to be performed at least part of the herein-described methods and algorithms and/or at least part of the functionality of the systems described herein.

In practice, different hearing prosthesis recipients use different configuration settings. This is usually the case because the configuration settings are tailored to the way in which the implant recipient's body responds to various applied stimulations. Typically, before a prosthesis recipient uses a hearing prosthesis (or other medical prosthesis, as the case may be), and perhaps at several milestones along the life of the hearing prosthesis, a trained professional conducts a fitting session. At a fitting session, the professional, such as an audiologist, conducts one or more tests to determine an appropriate set of configuration settings for the given hearing prosthesis and for the recipient.

One example test that may be carried out during a fitting session is a feedback path measurement. A feedback path measurement indicates the way in which the particular hearing prosthesis and the particular hearing prosthesis recipient's body respond to various types of stimulation. For example, sound 307 results in transducer module 306 providing a stimulation, in one form or another, to the recipient. Such stimulation sometimes manifests itself back at the sound input element 302 in the form of audible feedback. In such a situation, the transducer module 306 provides an additional stimulation in accordance with this received feedback signal. This, in turn, can result in more feedback, thereby resulting ultimately in a feedback loop.

Feedback signals tend to produce undesirable sound sensations, sometimes referred to as feedback artifacts, for the prosthesis recipient. A feedback path measurement analyzes how feedback signals result, in response to various input signals received at the hearing prosthesis. During a typical fitting session, measurement commences with a fitting system providing audio signals isolated in each frequency band of the audible spectrum. The fitting system then measures the frequency response to each audio signal. The measurement provides an indication to the audiologist of how much more gain may be applied in each frequency band before audible feedback artifacts manifest. The measurement also provides an indication to the audiologist of where gain should be lessened in order to reduce the feedback artifacts. The audiologist is then able to adjust the gain in each frequency band in accordance with the results of the feedback path measurement.

One drawback to the feedback path measurement process described above is that it occupies a significant portion of the fitting session. Audiologists typically have a limited amount of time each day to engage in fitting sessions with prosthesis recipients. Therefore, if each fitting session could be made shorter in duration, the audiologist could engage in more fitting sessions, which would ultimately result in a better overall user experience.

In accordance with one embodiment described herein, a feedback path measurement portion of a fitting session is carried out simultaneously or concurrently with other (or all) portions of the fitting session. That is, a fitting system, such as the fitting system 400, in one embodiment, continuously collects and analyzes feedback path data for the hearing prosthesis in response to signals received at the hearing prosthesis 100 during other fitting session tests. By way of example, other fitting session tests include tests designed to evaluate a threshold level (i.e., a lowest signal power that a recipient is able to discern), a comfort level (i.e., a highest signal power that is still comfortable to the recipient), different sound coding strategies, and/or other types of configuration parameters.

In accordance with one embodiment described herein, the fitting system and/or the hearing prosthesis filters out and/or refuses to store certain feedback data, in order to help collect reliable feedback path data for feedback measurements carried out continuously during fitting sessions. For example, in accordance with one particular embodiment, the fitting system or the hearing prosthesis will not collect feedback path data for frequency bands of an output signal that do not have an output power level above a threshold output power level. In accordance with another embodiment, the fitting system or the hearing prosthesis analyzes a quality value (e.g., signal coherence or standard deviation) of the feedback signal resulting from a feedback stimulus signal. If the quality value is less than a threshold quality value, the fitting system or the hearing prosthesis causes an additional feedback stimulus to be generated. Other ways of continuously measuring feedback path information are possible as well.

Figure 5:
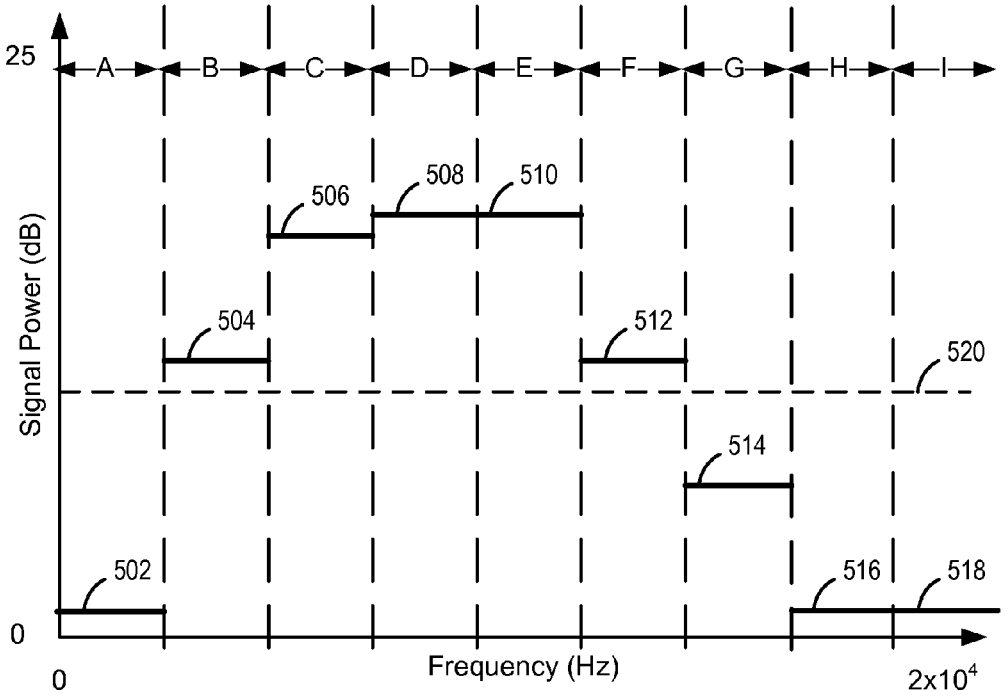
FIG. 5 depicts a signal-power graph of an example signal, in accordance with one embodiment.

To help illustrate the process noted above, reference is made to an example signal-power graph of FIG. 5, which depicts an example audio signal produced by a hearing prosthesis, such as the hearing prosthesis 300, during a fitting session. The signal-power graph of FIG. 5 depicts nine frequency bands (A-I). In the example depicted, there is an average output power level for each frequency band. Specifically, the output power level in band A is depicted by signal part 502, the output power level in band B is depicted by signal part 504, the output power level in band C is depicted by signal part 506, the output power level in band D is depicted by signal part 508, the output power level in band E is depicted by signal part 510, the output power level in band F is depicted by signal part 512, the output power level in band G is depicted by signal part 514, the output power level in band H is depicted by signal part 516, and the output power level in band I is depicted by signal part 518.

Also depicted in FIG. 5 is a signal threshold 520. In accordance with one embodiment of the present disclosure, the fitting system or hearing prosthesis receives a test signal (sometimes referred to as a feedback stimulus), and in response, generates an output stimulation. The signal parts 502-518 represent the average signal power levels in each frequency band of the output stimulation. The fitting system or hearing prosthesis then determines which frequency bands have an output stimulation signal part that has a power level greater than the threshold power level 520. In the illustrated example, such frequency bands are B-F. Consequently, the fitting system or hearing prosthesis analyzes the feedback path for frequency bands B-F, as depicted in FIG. 5. However, in other embodiments, other ways of selecting frequency bands of an output signal for feedback path analysis are possible as well. For example, the fitting system or hearing prosthesis could determine which frequency bands have an output stimulation signal part that has a power level greater than or equal to (or perhaps just below) the threshold power level 520.

Figure 6:
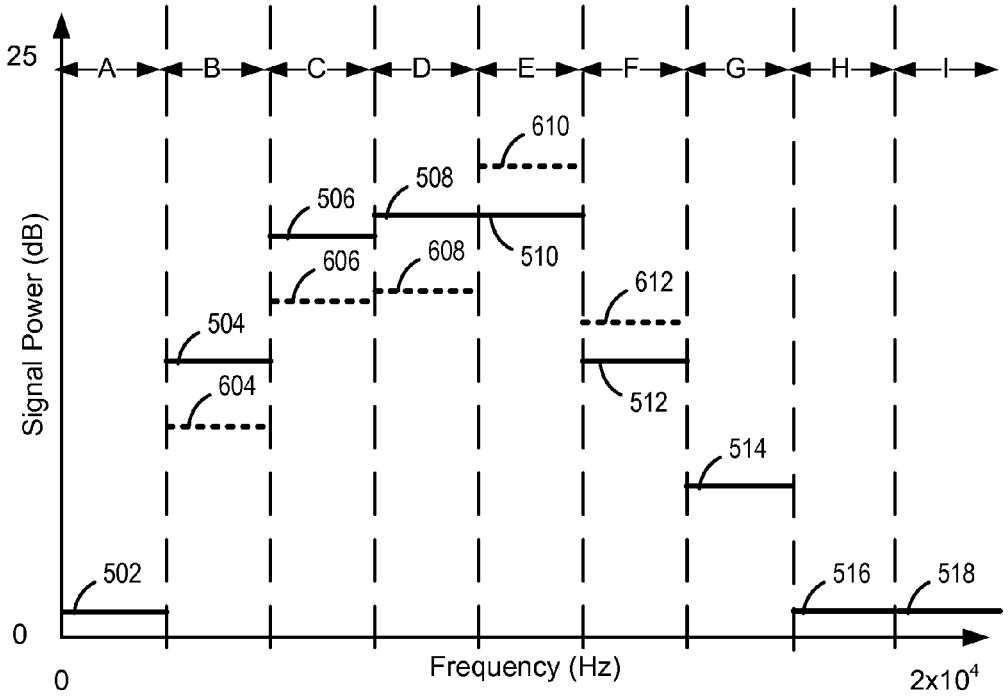
FIG. 6 depicts a signal-power graph of an example signal and an example feedback signal, in accordance with one embodiment.

FIG. 6 depicts the signal-power graph of FIG. 5 overlaid with an average feedback signal power level indicated for frequency bands B-F for an example feedback response signal. In the example depicted, the feedback signal power level for band B is depicted by signal part 604, the feedback signal power level for band C is depicted by signal part 606, the feedback signal power level for band D is depicted by signal part 608, the feedback signal power level for band E is depicted by signal part 610, and the feedback signal power level for band F is depicted by signal part 612. The feedback signal power levels in bands E and F are greater than the input power levels in those bands (indicating a potential feedback loop), while the feedback signal power levels in bands B, C, and D are less than the input power levels in those bands. Reducing the gain in bands E and F should result in a corresponding decrease in the feedback signal power levels in bands E and F. Similarly, an appropriately increased gain (i.e. so the resulting feedback signal power level does not exceed the threshold power level 520) in bands B, C, and D should be possible without resulting in a feedback loop. This "gain margin" is the difference between the threshold power level 520 and the feedback signal power levels, and may be utilized (e.g. by an audiologist) as appropriate to improve the fitting of the hearing prosthesis to the recipient.

In additional embodiments, the fitting system or hearing prosthesis conducts a quality analysis of the received feedback signal. For example, the fitting system or hearing prosthesis conducts a quality analysis of the received signal from FIG. 6, comprising signal parts 604-612. In accordance with one embodiment, the fitting system or hearing prosthesis evaluates the coherence of the received feedback signal. If the coherence value of the received feedback signal is below a threshold coherence value, then the fitting system or hearing prosthesis discards the feedback path measurement and, in some embodiments, causes an additional feedback stimulus to be generated to attempt the measurement again. In accordance with another embodiment, the fitting system or hearing prosthesis evaluates the standard deviation of calculated feedback gain margins. If the calculated standard deviation is outside the range of an acceptable or threshold deviation, then the fitting system or hearing prosthesis discards the feedback path measurement and, in some embodiments, causes an additional feedback stimulus to be generated to attempt the measurement again. Other ways of measuring the quality of the feedback signal are possible as well.

In still further embodiments, the fitting system or hearing prosthesis engages in a feedback cancellation algorithm, such as by performing a process in which a filter is developed to cancel some or all of a feedback signal. The feedback cancellation algorithm can include one or more coefficients being displayed or otherwise indicated to an audiologist or other user. The one or more coefficients indicate feedback path information for each frequency band, for example. In some embodiments, these coefficients can be aggregated over some (or all) of the fitting session in order to improve a quality of a feedback path measurement. However, in some embodiments, the coefficients of the feedback cancellation algorithm are aggregated for only those frequency bands that have at least a threshold level of power in the output stimulation signal. Other ways of aggregating feedback filter data are possible as well.

Figure 7:
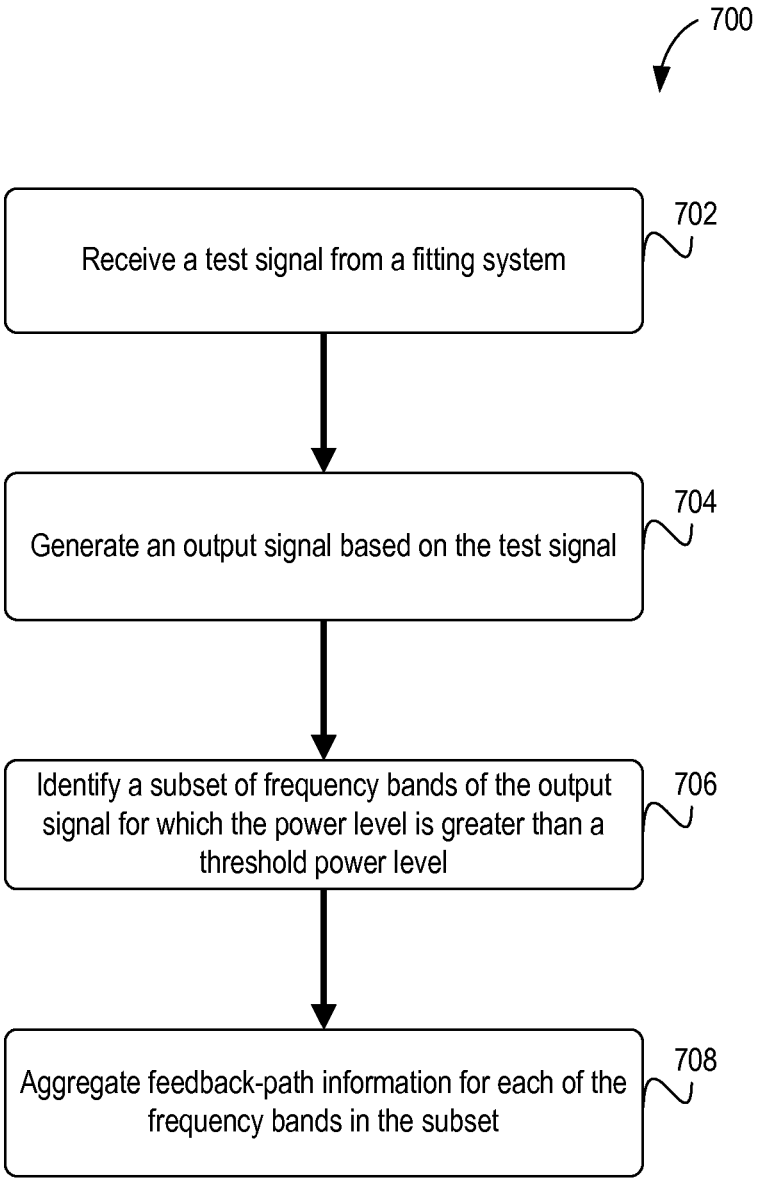
FIG. 7 depicts a flow chart, in accordance with one embodiment.

FIG. 7 is a flowchart depicting an example method 700 for collecting and analyzing feedback path information for a hearing prosthesis engaged in a fitting session. The functions identified in the individual blocks of the method depicted in FIG. 7 may be executed by one or more of the modules of hearing prosthesis 300, such as electronics module 304, or by one or more of the components of fitting system 400, such as the one or more processors 403. As depicted, the method begins at block 702, where a processor (e.g., a processor of electronics module 304) receives a test signal from a fitting system, such as fitting system 400. The test signal may be a signal designed to test other components or parameters (in addition to feedback) of hearing prosthesis 300. By way of example, the test signal received at block 702 may be a test signal designed to test the threshold or comfort levels of the hearing prosthesis.

At block 704, a processor generates an output signal based on the test signal. For example, the output signal may be an amplified version of the test signal, amplified in accordance with a particular stimulation strategy. For example, the output signal is the signal that gives rise to feedback signals, if any.

At block 706, a processor identifies a subset of frequency bands of the output signal for which the power level is greater than a threshold power level. Parts of the output signal that are greater than a threshold power level provide an indication of feedback path information.

At block 708, a processor aggregates feedback path information for each of the frequency bands in the subset. As indicated above, this may entail evaluating feedback gain margins for each band, or analyzing filter coefficients of a feedback cancellation filter, for example.

In some embodiments, the disclosed features and functions of the systems, methods, and algorithms shown and described herein may be implemented as computer program instructions encoded on a computer readable media in a machine-readable format.

Figure 8:
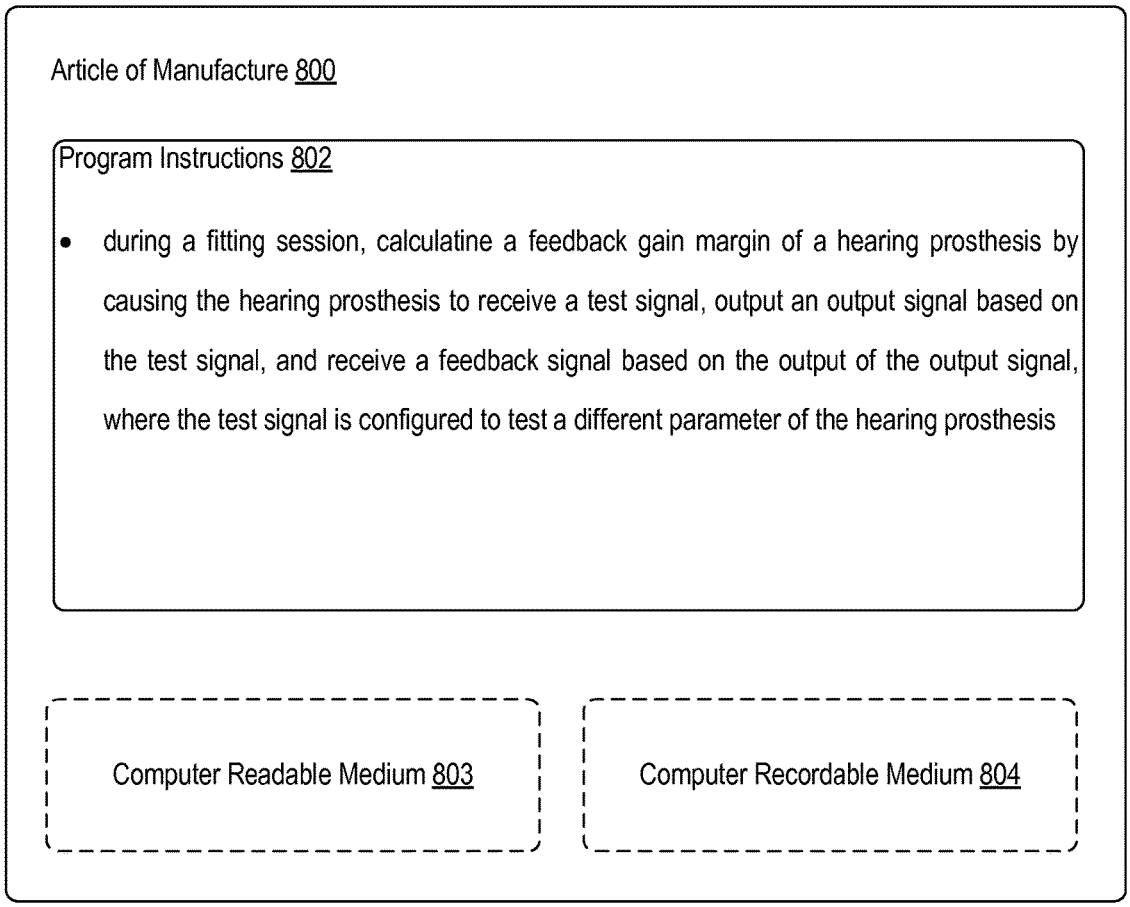
FIG. 8 depicts an article of manufacture including computer readable media with instructions for executing functions, in accordance with one embodiment.

FIG. 8 depicts an example of an article of manufacture 800 including computer readable media having instructions 802 for executing a computer process on a computing device, arranged according to at least some embodiments described herein. In some implementations, the article of manufacture 800 includes a non-transitory computer recordable medium 804, such as, but not limited to, a hard disk drive, Compact Disc (CD), Digital Video Disk (DVD), a digital tape, flash memory, etc.

The one or more programming instructions 802 may be, for example, computer executable and/or logic implemented instructions. In some embodiments, electronics module 304 of hearing prosthesis 300, alone or in combination with one or more processors, may be configured to perform various operations, functions, or actions to implement the features and functionality of the disclosed systems and methods based at least in part on the programming instructions 802.

Advantages that may be realized from the above-described embodiments include a more efficient fitting process, since feedback testing is performed concurrently with other fitting tasks. In addition, embodiments of the invention may help to avoid the recipient experiencing uncomfortable sounds that might otherwise be caused by conventional feedback measurement techniques.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A method comprising:

a hearing prosthesis receiving a test signal from a fitting system, the test signal being configured for testing a parameter in addition to feedback signals present in the hearing prosthesis;

the hearing prosthesis generating an output signal based on the received test signal, the output signal spanning a plurality of frequency bands, with each individual frequency band having associated therewith a component output signal;

the hearing prosthesis identifying from among the plurality of frequency bands a subset of frequency bands, in which each frequency band of the subset has an associated component output signal with a power level greater than a threshold power level;

in response to generating the output signal, receiving at a transducer of the hearing prosthesis an input signal, the input signal spanning the plurality of frequency bands, with each individual frequency band having associated therewith a component input signal; and in response to the identifying and receiving the input signal, aggregating feedback-path information for each frequency band in the identified subset of frequency bands, wherein aggregating feedback path information further includes:

measuring, for each given frequency band in the identified subset of frequency bands, a power level of the component input signal associated with the given frequency band; and based on the measuring, calculating a feedback gain margin for each given frequency band in the identified subset of frequency bands.

2. The method of claim 1, wherein the feedback gain margin is a difference between the threshold power level and the power level of the component input signal.

3. The method of claim 1, further comprising:

in response to the measuring, calculating, for each given component input signal, a quality value of the given component input signal;

based on the calculating, determining a set of at least one component input signal that has a quality value that is less than a threshold quality value; and in response to the determining, causing a feedback stimulus to be generated for the set of component input signals.

4. The method of claim 3, wherein the quality value is a coherence value.

5. The method of claim 3, wherein the quality value is a standard deviation value.

6. The method of claim 2, wherein the hearing prosthesis is a bone-anchored hearing prosthesis.

7. The method of claim 1, wherein aggregating feedback path information for each frequency band in the identified subset of frequency bands comprises:

invoking a feedback path process, in which a cancellation filter is generated for the hearing prosthesis, the cancellation filter being configured to mitigate the feedback signals present in the hearing prosthesis in response to receipt at the transducer of the input signal.

8. The method of claim 1, wherein the test signal is received from the fitting system during a fitting session.

9. The method of claim 8, wherein the signal is a test signal configured to test threshold levels or comfort levels.

10. A hearing prosthesis comprising:

a sound input element;

a transducer module communicatively coupled to the sound input element; and one or more processors coupled to at least one of the sound input element and the transducer module, the one or more processors being configured for (i) receiving via the sound input element a signal from an external system, wherein in response to the receiving, the transducer module provides a stimulation signal; (ii) identifying parts of the stimulation signal that have a power level above a threshold power level; and (iii) aggregating feedback path information for each identified part of the stimulation signal, wherein aggregating the feedback path information for each identified part of the stimulation signal comprises:

the transducer module applying stimulation in accordance with the stimulation signal;

receiving via the sound input element, a feedback signal, the feedback signal being generated in response to the transducer module providing the stimulation signal;

for each given part of the feedback signal that corresponds to an identified part of the stimulation signal, measuring a power level of the given part of the feedback signal; and based on the measuring, calculating a feedback gain margin for each given part of the feedback signal that corresponds to an identified part of the stimulation signal.

11. The hearing prosthesis of claim 10, wherein the feedback gain margin is a difference between the threshold power level and the power level of the given part of the feedback signal.

12. The hearing prosthesis of claim 10, wherein the one or more processors are further configured for:

in response to the measuring, calculating, for each given part of the feedback signal that corresponds to an identified part of the stimulation signal, a quality value of the given part;

based on the calculating, determining a set of at least one feedback signal part that has a quality value less than a threshold quality value; and in response to the determining, causing an additional feedback stimulus to be generated for the set of feedback signal parts.

13. The hearing prosthesis of claim 12, wherein the quality value is a coherence value.

14. The hearing prosthesis of claim 12, wherein the quality value is a standard deviation value.

15. The hearing prosthesis of claim 10, wherein the signal received from an external system is a signal configured to test threshold levels or comfort levels during a fitting session.

16. A system comprising:

memory storage;

at least one processor; and program code stored in the memory storage, wherein the program code is executable by the processor to carry out functions comprising:

during a fitting session, calculating a feedback gain margin of a hearing prosthesis for only those parts of an output signal that have a power level greater than a threshold power level, wherein calculating the feedback gain margin is performed by causing the hearing prosthesis to (i) receive a test signal, (ii) provide the output signal based on the test signal, and (iii) receive a feedback signal based on the output signal, the test signal being configured to test a different parameter of the hearing prosthesis in addition to the feedback gain margin.

17. The system of claim 16, wherein the different parameter includes threshold levels or comfort levels.

18. The system of claim 16, wherein the system is a bone conduction hearing prosthesis.

19. The system of claim 16, wherein the system is a fitting system.

* * * * *